United States Patent [19]

Kostiainen et al.

[11] 4,022,231

[45] May 10, 1977

[54] CHIP WASHER

[75] Inventors: Aatos Kostiainen; Ilmari Paakkinen; Paavo Rantasuo, all of Savonlinna, Finland

[73] Assignee: Enso-Gutzeit Osakeyhtio, Helsinki, Finland

[22] Filed: Apr. 12, 1976

[21] Appl. No.: 675,956

[30] Foreign Application Priority Data

Apr. 30, 1975 Finland ..... 751292

[52] U.S. Cl. ..... 134/133; 209/3; 209/10; 209/162

[51] Int. Cl.[2] ..... B08B 3/04

[58] Field of Search ..... 209/3, 10, 162, 173; 134/133

[56] References Cited

UNITED STATES PATENTS

| | | | |
|---|---|---|---|
| 1,596,392 | 8/1926 | Blatch | 209/173 |
| 2,881,923 | 4/1959 | Nelson | 209/162 X |
| 3,452,862 | 7/1969 | Amadon et al. | 209/3 X |
| 3,708,063 | 1/1973 | Morimasa | 209/3 |
| 3,791,630 | 2/1974 | Hinds, Jr. | 134/133 X |

FOREIGN PATENTS OR APPLICATIONS

| | | | |
|---|---|---|---|
| 1,221,620 | 6/1960 | France | 209/162 |
| 200,732 | 7/1923 | United Kingdom | 209/3 |

*Primary Examiner*—Robert L. Bleutge
*Attorney, Agent, or Firm*—Lewis H. Eslinger

[57] ABSTRACT

A chip washer which has its cylindrical upper part an upwards directed outlet pipe and an outlet channel for washed chips and in which the foreign materials separated from the chips sink into the funnel part attached to the upper part as its continuation, the funnel part having been linked by means of a valve to a tubular part to remove foreign materials. The washer is partly or entirely filled with a washing liquid which is introduced tangentially from close to the edge of the upper part of the washer in such a manner that the washing liquid is put into a circulatory motion forcing the chips fed from the upper part of the washer downwards in the circular space between the side wall of the upper part and the outlet pipe, whereby the chips freed from foreign materials pass into the outlet pipe and from there into the outlet channel, and the foreign materials pass into the funnel part and further through the valve into the tubular part.

8 Claims, 4 Drawing Figures

CHIP WASHER

BACKGROUND OF THE INVENTION

The present invention relates to a chip washer for removing from wood foreign materials which could damage the machines used in the cellulose and paper industry and would lower the quality of the pulp and paper produced.

Some such materials are bark, stones, sand, glass fragments, and scrap iron.

Washers of the plane sieve type, described in, for example, Finnish Pat. No. 46,752, are commonly used for washing chips.

The disadvantages of such a washer are its great space requirement, the large amount of washing water it requires, and its expensive construction.

The object of the present invention is to provide a device in which the above drawbacks have been eliminated but which washes efficiently and dependably.

SUMMARY OF THE INVENTION

The chips are fed into an upper cylinder of a container, close to its outer edge, and are pressed under the water surface in the container by means of separate water sprays. These water sprays simultaneously detach foreign materials from the chips by beating them vigorously in the water, which circulates under the effect of the sprays. This is an essential difference in comparison with hydrocyclones. In the upper cylinder of the washer there is a vertical outlet pipe which has a completely open lower end. The water sprays force the chips to the lower edge of the outlet pipe and from there inside the pipe, from where a portion of the chips passes into the outlet channel whereas another portion may be recycled as an overflow over the upper edge of the outlet pipe.

Foreign materials heavier than water sink to the bottom of a funnel, where there is a pipe. A water spray is optionally directed at this part also, and the water spray returns upwards and into the overflow any chips which may have passed there. Foreign materials accumulate at the bottom of the tubular part, from where they are removed.

DESCRIPTION OF THE PREFERRED EMBODIMENT

Figure 1:
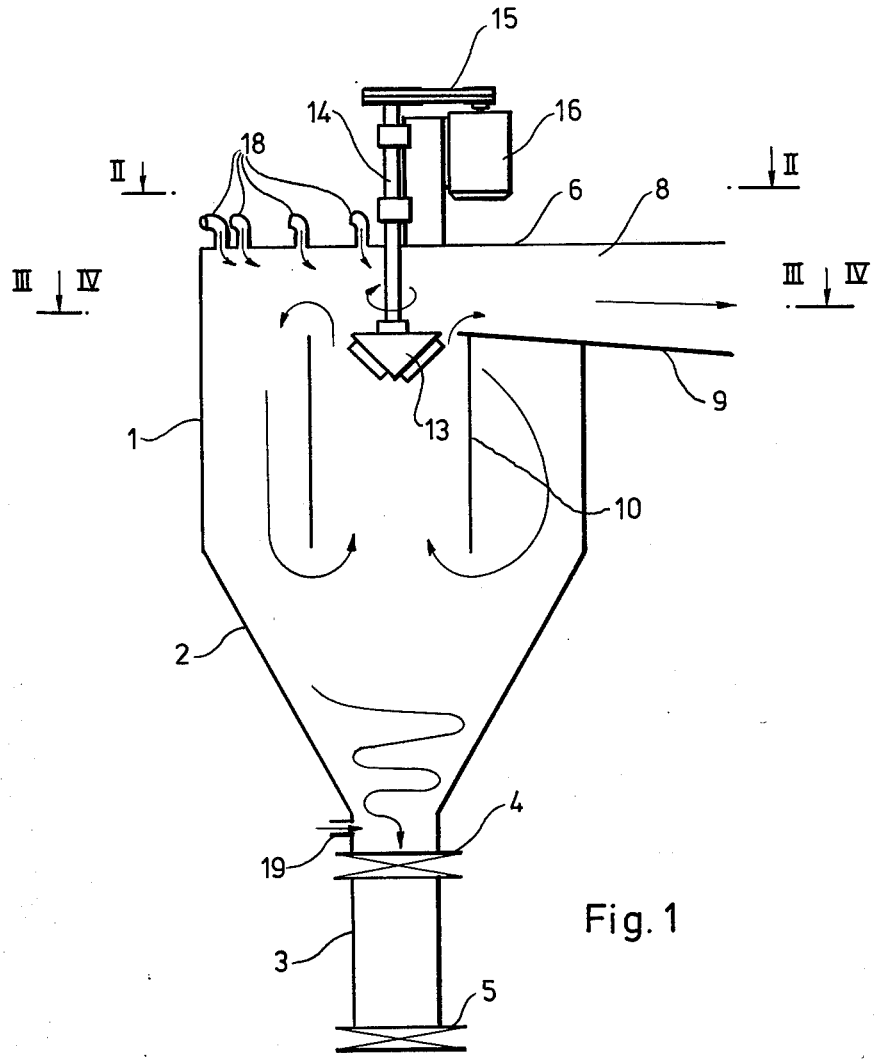
FIG. 1 depicts a cross section of a side view of a device according to the invention.
Figure 2:
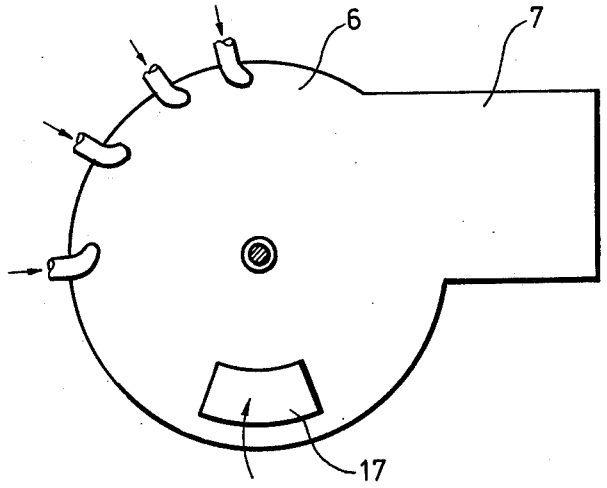
FIG. 2 depicts a plan view of the device, as a cross section along line II—II in FIG. 1.
Figure 3:
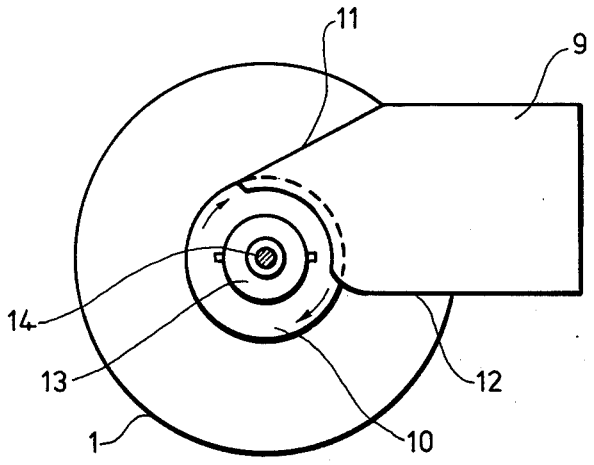
FIG. 3 depicts a cross section along line III—III in FIG. 1.

A chip washer according to the invention comprises a cylindrical upper part 1, a funnel part 2 as its continuation, and a pipe 3 attached to the latter as well as its valves 4 and 5. The upper part 1 of the chip washer is closed by means of a lid 6, from which an almost tangential part 7 departs on the same plane and forms a roof for the outlet channel 8. The floor plate 9 of the outlet channel 8 extends inside the cylindrical part 1, and an outlet pipe 10, concentric with the cylindrical part 1, has been attached to the lower surface of the edge of the floor plate 9. In the outlet channel 8 there is the first vertical side wall 11 in the direction of the liquid circulation, and the wall 11 is linked tangentially to the upper edge of the wall of the outlet pipe 10. A vertical side wall 12 further in the direction of the liquid circulation has been welded to the floor plate 9 of the outlet channel and intersects the side wall of the pipe 10 in such a manner that this intersection point and the tangential point of the side wall 11 on the wall of the outlet pipe 10 delimit an arc of approx. 120° on the circumference of the pipe 10 (FIG. 3). The upper end of the outlet pipe 10 is thus open over approx. 240°. Inside the outlet pipe 10 rotates a rotor 13, which is driven by a motor 16 by transmission of a shaft 14 and a belt 15. The rotational direction of the rotor 13 is clockwise, i.e., towards the outlet channel 8, according to FIG. 1. In the lid 6 of the chip washer, close to its edge, is an opening 17, for the chips, and water spray pipes 18, which are almost tangent to the wall of the cylindrical part (FIG. 2). The water sprays 18 can also be positioned tangentially in the side wall of the upper part of the washer. Furthermore, in the pipe 3 above the valve 4 there is a tangential water spray 19.

OPERATION

Figure 4:
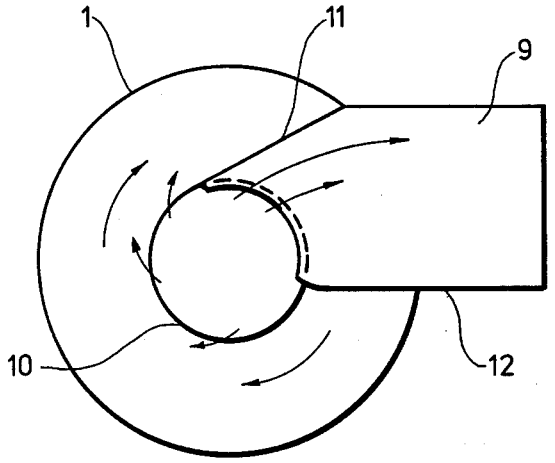
FIG. 4 depicts a view along the line IV—IV which is on the same plane as the line III—III in FIG. 1, and illustrates the flows occurring in the upper part of the device.

The chips to be washed are fed into the device through the opening 17, whereby they arrive in the circular space between the outlet pipe 10 and the inner wall of the cylinder 1. Under the effect of the tangential sprays emerging from the spray pipes 18 the water circulates clockwise in the said circular space (FIG. 4). When the chips arrive at the sprays 18, they are pressed under the water surface by the sprays. The chips are pressed further downwards during the circulatory motion (the long arching arrow in FIG. 1). The first side wall 11 in the direction of the liquid circulation prevents the chips from passing unwashed into the outlet channel 8. When the chips sink, heavy foreign materials such as stones, sand, scrap iron, watersoaked bark, etc. are detached from them. The washing effect is promoted by the beating effect of the sprays and the turbulence caused by the sprays. When the rotor 13 rotates clockwise in accordance with FIG. 1, the chips freed from heavy foreign materials are sucked into the pipe 10, and a portion of these chips is removed into the outlet channel 8 through the opening formed by the floor plate 9 and the side walls 11 and 12. The rotor is protected from damage caused by stones, etc. by its location in the washed-chips part. Another portion of the chips returns through the clearance between the rotor 13 and the left wall of the outlet pipe 10 (FIG. 1) into the clearance between the outlet pipe 10 and the wall of the cylindrical part 1 and is returned to the lower end of the pipe 10 and from there into the outlet pipe 10. The device is characterized by a small washing-water requirement, an advantage which can be augmented by means of the said return flow.

The heavy foreign particles detached from the chips sink further into the funnel part 2. The spray 19 above the valve 4 detaches the chips possibly accompanying the heavy materials and produces a turbulence which lifts the chips into the funnel part 2 and further through the outlet pipe 10 into the outlet channel 8 or back into the circulation in the cylindrical part 1. By opening the valve 4 at times the heavy materials can be removed into the pipe 3, which can have a transparent wall through which the part above the valve 5 can be observed to see when it is full of material to be removed; the pipe 3 can be emptied by opening the valve 5.

What is claimed is:

1. A chip washer of the type having an upright container with an upper cylinder and a lower funnel fitted with valve means for removing foreign materials from the container, comprising:

a substantially vertical outlet pipe inside the cylinder and forming an annular space therewith, means for feeding chips to the upper part of the annular space, means for tangentially introducing washing liquid from close to the edge of the cylinder for bringing the chips and the washing liquid in the annular space into a circulatory motion forcing the chips downwards to separate the foreign materials from the chips and pass the washed chips into the outlet pipe, and an outlet channel connected to the outlet pipe for removing the washed chips from the container.

2. The chip washer of claim 1, further comprising a lid closing the top of the cylinder and having an opening for introducing the chips, the means for introducing the washing liquid comprising sprays in the lid.

3. The chip washer of claim 1, in which the means for introducing the washing liquid are sprays mounted in the wall of the cylinder.

4. The chip washer of claim 1, further comprising a lid closing the top of the cylinder and having an opening close to its edge and before the means for introducing washing liquid, the means for introducing the chips being arranged to feed the chips through said opening and in the direction of the washing liquid.

5. The chip washer of claim 1, further comprising a rotor in the outlet pipe for promoting the circulatory movement of the washing liquid.

6. The chip washer of claim 5, in which the outlet pipe is open also upwards to allow recycling part of the washed chips into the annular space.

7. The chip washer of claim 6, wherein the outlet channel comprises a top wall almost tangent to the cylinder, on the same plane as the lid, a first side wall in the direction of the washing liquid circulation, attached tangentially to the upper edge of the outlet pipe, a second side wall in the direction of the washing liquid circulation, attached radially to the upper edge of the outlet pipe, and a bottom wall attached to the upper edge of the outlet pipe over a distance of an arc of approx. 120°, the rest of the circumference of the upper edge of the outlet pipe forming an overflow into the annular space.

8. The chip washer of claim 7, further comprising a tangential spray in the funnel immediately above the valve means for creating turbulence and return any chips which may have passed into the funnel.

* * * * *

UNITED STATES PATENT OFFICE

CERTIFICATE OF CORRECTION

Patent No. 4,022,231 Dated May 10, 1977

Inventor(s) Aatos Kostiainen et al.

It is certified that error appears in the above-identified patent and that said Letters Patent are hereby corrected as shown below:

In the heading,

[75] Change the Inventors from

"Aatos Kostainen; Ilmari Paakkinen; Paavo Rantasuo, all of Savonlinna, Finland"

to

--Aatos Kostainen; Ilmari Paakkinen; Paavo Rantasuo; Seppo Vilhunen; all of Savonlinna, Finland--

In the Abstract:

line 1, change "has its" to --has in its--.

Signed and Sealed this

Fourth Day of April 1978

[SEAL]

Attest:

RUTH C. MASON
Attesting Officer

LUTRELLE F. PARKER
Acting Commissioner of Patents and Trademarks